US008981658B2

(12) United States Patent
Lee et al.

(10) Patent No.: US 8,981,658 B2
(45) Date of Patent: Mar. 17, 2015

(54) APPARATUS FOR DRIVING LIGHT EMITTING DIODE

(71) Applicant: Samsung Electro-Mechanics Co., Ltd., Suwon, Gyunggi-do (KR)

(72) Inventors: Yun Joong Lee, Gyunggi-do (KR); Je Hyeon Yu, Gyunggi-do (KR); Sang Hyun Cha, Gyunggi-do (KR); Deuk Hee Park, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 130 days.

(21) Appl. No.: 13/891,948

(22) Filed: May 10, 2013

(65) Prior Publication Data

US 2014/0184086 A1 Jul. 3, 2014

(30) Foreign Application Priority Data

Dec. 28, 2012 (KR) ..... 10-2012-0155771

(51) Int. Cl.
*H05B 33/08* (2006.01)

(52) U.S. Cl.
CPC ..... *H05B 33/0824* (2013.01)
USPC ..... 315/224; 315/185 R; 315/307

(58) Field of Classification Search
USPC ..... 315/307, 308, 224, 185 R, 192, 191, 315/194, 186
See application file for complete search history.

(56) References Cited

U.S. PATENT DOCUMENTS

| | | | | |
|---|---|---|---|---|
| 8,339,049 | B2 * | 12/2012 | Kang et al. | 315/185 R |
| 2010/0090604 | A1 * | 4/2010 | Maruyama et al. | 315/119 |
| 2011/0273103 | A1 | 11/2011 | Hong | |

FOREIGN PATENT DOCUMENTS

| | | | |
|---|---|---|---|
| KR | 20020013362 | A | 2/2002 |
| KR | 2008-0099492 | A | 11/2008 |
| KR | 10-0900769 | B1 | 6/2009 |
| KR | 10-0995793 | B1 | 11/2010 |
| KR | 10-0997050 | B1 | 11/2010 |
| KR | 10-1018171 | B1 | 2/2011 |
| KR | 2011-0126869 | A | 11/2011 |
| KR | 2012-0054517 | A | 5/2012 |

OTHER PUBLICATIONS

Korean Office Action issued in Korean Application No. 10-2012-0155771 dated Mar. 28, 2014, w/English translation.

* cited by examiner

*Primary Examiner* — David H Vu
(74) *Attorney, Agent, or Firm* — McDermott Will & Emery LLP

(57) ABSTRACT

There is provided an apparatus for driving a light emitting diode (LED), performing switching-operation with respect to a pair of LED groups by a phase difference of 180 degrees. The apparatus includes a switching unit that alternately switches a first LED unit and a second LED unit of at least one pair of LED units emitting light by receiving rectified power, in accordance with a predetermined phase difference, a current limiting unit that limits a current flowing in the at least one pair of LED units through the switching of the switching unit, and a driving control unit that controls switching driving of the switching unit in accordance with a voltage level of the rectified power.

17 Claims, 4 Drawing Sheets

APPARATUS FOR DRIVING LIGHT EMITTING DIODE

CROSS-REFERENCE TO RELATED APPLICATIONS

This application claims the priority of Korean Patent Application No. 10-2012-0155771 filed on Dec. 28, 2012, in the Korean Intellectual Property Office, the disclosure of which is incorporated herein by reference.

BACKGROUND OF THE INVENTION

1. Field of the Invention

The present invention relates to an apparatus for directly driving alight emitting diode (LED) with alternating current (AC) power.

2. Description of the Related Art

A Light Emitting Diode (LED) is a semiconductor device having a p-n junction structure and emitting light through the recombination of electrons and holes, and has recently been applied to various technological fields in accordance with the development of semiconductor technologies. In particular, LEDs have high efficiency, relatively long service lives, and environmentally friendly characteristics, as compared to existing incandescent light bulbs, and therefore applications thereof have been continuously broadened.

In general, LEDs may be driven by applying several volts of direct current (DC) power thereto, due to structures thereof, and therefore a separate unit is required in order to drive an LED with commercially available alternating current (AC) power which is generally used in domestically, commercially, industrially, and the like. In order to drive an LED with commercially available AC power, an apparatus for driving an LED includes a rectifier circuit, an AC-DC converter, and the like.

However, a general AC-DC converter has a large volume and high power consumption, and therefore, when the general AC-DC converter is applied to the apparatus for driving an LED, LED advantages such as high efficiency, a small packaging size, a long service life, and the like may be offset thereby.

Therefore, in recent years, research into an apparatus for directly driving an LED with AC power without any AC-DC converter has been conducted.

In a case in which an LED is directly driven by AC power without an AC-DC converter, a method of enabling a current to flow at a constant rate in such a manner that a plurality of LEDs may be respectively connected to a plurality of switches, and ON/OFF switching of the plurality of switches may be controlled in accordance with levels of the AC power may be generally used.

In the Related Art Document below, Patent Document 1 discloses an apparatus for driving an LED. Here, the apparatus may emit light directly from an LED with AC power by controlling operations of switches connected to middle and final nodes of an LED array. In Patent Document 2, there is disclosed an apparatus for driving an LED. Here, the apparatus may control ON/OFF switching of switches in an order in which an LED array is connected to the switches.

However, in both Patent Documents 1 and 2, technology for controlling the operation of the switch in accordance with levels of AC power has been described, but there is a problem in that electro-magnetic interference (EMI) may occur due to the switching operation. As a result, in order to solve this problem, a separate EMI filter may be adopted, resulting in increases in manufacturing costs and in a circuit area.

Related Art Document (Patent Document 1) Korean Patent Registration Publication No. 10-0997050

(Patent Document 2) Korean Patent Registration Publication No. 10-0995793

SUMMARY OF THE INVENTION

An aspect of the present invention provides an apparatus for driving an LED, enabling a pair of LED groups to be switch-operated by a phase difference of 180 degrees therebetween.

According to an aspect of the present invention, there is provided an apparatus for driving a light-emitting diode (LED), including: a switching unit that alternately switches a first LED unit and a second LED unit of at least one pair of LED units emitting light by receiving rectified power, in accordance with a predetermined phase difference; a current limiting unit that limits a current flowing in the at least one pair of LED units through the switching of the switching unit; and a driving control unit that controls switching driving of the switching unit in accordance with a voltage level of the rectified power.

Each of the first and second LED units may include a plurality of LEDs connected to each other in series.

The switching unit may include a switch group having a plurality of switches respectively connected between a connection point between respective LEDs of the plurality of LEDs of each of the first and second LEDs units and the current limiting unit.

The switching unit may include a first switch group connected to the first LED unit of the at least one pair of LED units and a second switch group connected to the second LED unit thereof.

The driving control unit may control the alternate switching of the switching unit by a phase difference of 180 degrees.

The driving control unit may include a comparison unit that compares the rectified power with a predetermined reference voltage, a driving unit that provides a switching driving signal for controlling the switching driving of the first LED unit of the at least one pair of LED units in accordance with a comparison result of the comparison unit, and a phase shift unit that shifts a phase of the switching driving signal from the driving unit so as to control switching driving of the second LED unit.

The comparison unit may include a plurality of comparators corresponding to the number of LEDs contained within the first or second LED unit.

The driving unit may provide a plurality of switching driving signals corresponding to the number of LEDs contained within the first LED unit.

Each of the first and second switch groups may include a plurality of switches corresponding to the number of the plurality of LEDs contained within the first or second LED unit.

The apparatus for driving a light-emitting diode may further include a rectifying unit that rectifies alternating current (AC) power and provides the rectified AC power to the at least one pair of LED units.

According to another aspect of the present invention, there is provided an apparatus for driving a light-emitting diode (LED), including: a rectifying unit that rectifies AC power and provides the rectified AC power; a switching unit that includes a first switch group for driving a first LED unit of at least one pair of LED units emitting light by receiving the rectified power from the rectifying unit and a second switch group for driving a second LED unit of the at least one pair of LED units, and alternately switches the first switch group and the second switch group in accordance with a predetermined phase difference; a current limiting unit that limits a current flowing in each of the first and second LED units through the switching of the switching unit; and a driving control unit that controls switching driving of the switching unit in accordance with a voltage level of the rectified power.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Hereinafter, embodiments of the present invention will be described in detail with reference to the accompanying drawings. The invention may, however, be embodied in many different forms and should not be construed as being limited to the embodiments set forth herein.

Rather, these embodiments are provided so that this disclosure will be thorough and complete, and will fully convey the scope of the invention to those skilled in the art.

Figure 1:
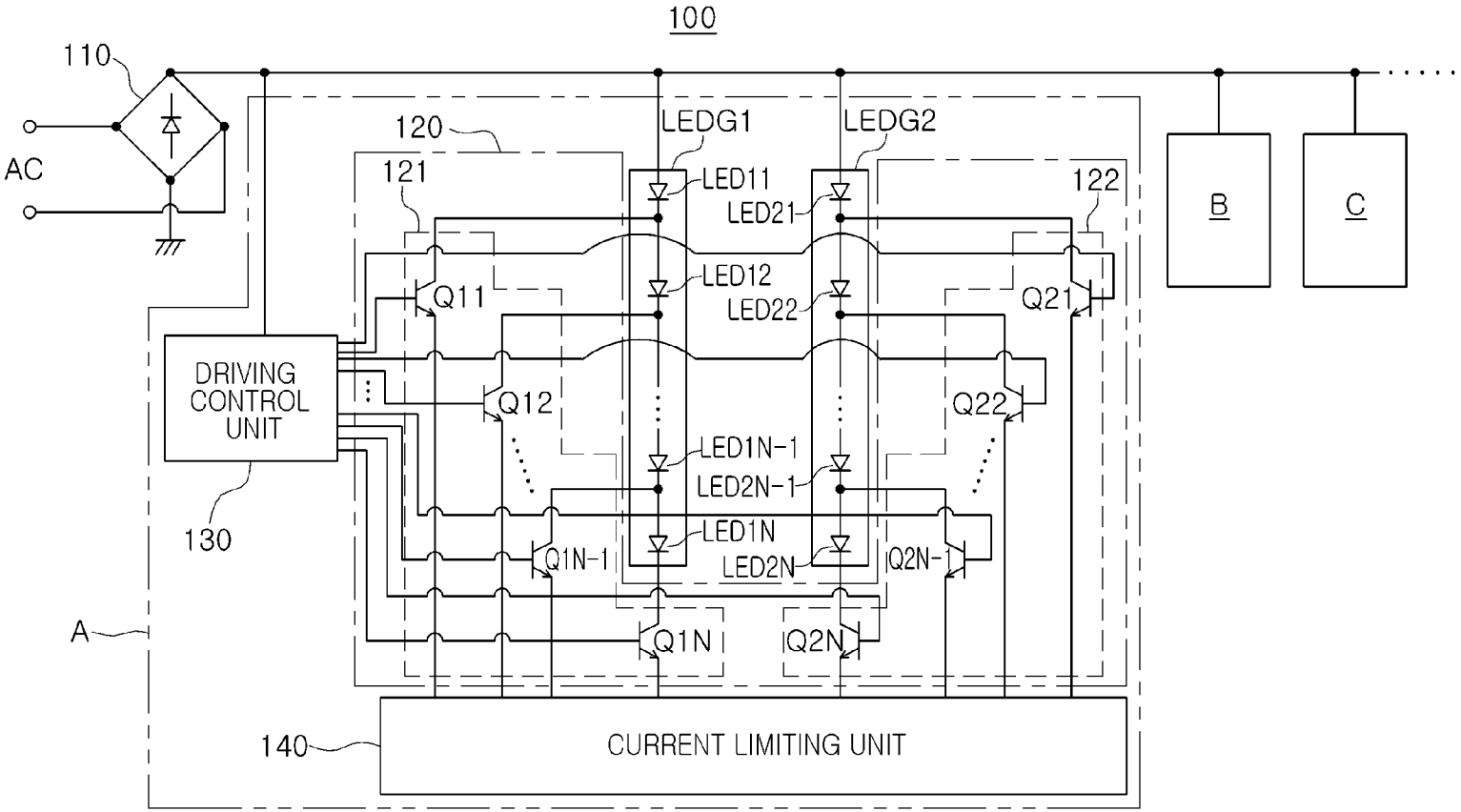
FIG. 1 is a schematic circuit diagram showing an apparatus for driving an LED according to an embodiment of the present invention.

FIG. 1 is a schematic circuit diagram showing an apparatus for driving an LED according to an embodiment of the present invention.

Referring to FIG. 1, an apparatus 100 for driving an LED according to an embodiment of the present invention may include a rectifying unit 110 and LED driving circuits A, B, and C.

The rectifying unit 110 may receive AC power to half-wave or full-wave rectify the received power through a bridge diode, and provide the rectified power rec to an LED so as to allow the LED to emit light.

Meanwhile, a plurality of LED driving circuits A, B, and C may be provided. The plurality of LED driving circuits A, B, and C may have the same configuration, and a single LED driving circuit A among theses will be described in detail.

The LED driving circuit A may include a pair of LED units LEDG1 and LEDG2, a switching unit 120, a driving control unit 130, and a current limiting unit 140.

The pair of LED units LEDG1 and LEDG2 may include a first LED unit LEDG1 and a second LED unit LEDG2 which are connected in parallel.

Each of the first LED unit LEDG1 and the second LED unit LEDG2 may include a plurality of LEDs LED11 to LED1N and LED21 to LED2N connected to each other in series.

The switching unit 120 may include a first switch group 121 and a second switch group 122.

The first and second switch groups 121 and 122 respectively have a plurality of switches, the first switch group 121 enables light-emitting operations of the plurality of LEDs LED11 to LED1N of the first LED unit LEDG1 to be performed or stopped, and the second switch group 122 enables light-emitting operations of the plurality of LEDs LED21 to LED2N of the second LED unit LEDG2 to be performed or stopped.

More specifically, the plurality of switches Q11 to Q1N of the first switch group 121 may respectively correspond to the plurality of LEDs LED11 to LED1N of the first LED unit LEDG1, and likewise, the plurality of switches Q21 to Q2N of the second switch group 122 may respectively correspond to the plurality of LEDs LED21 to LED2N of the second LED unit LEDG2.

The plurality of respective switches Q11 to Q1N and Q21 to Q2N are connected between a connection point connecting adjacent LEDs of the plurality of LEDs LED11 to LED1N and LED21 to LED2N and the current limiting unit 140 as shown in FIG. 1, and form a current path of corresponding LEDs by performing ON/OFF switching in accordance with switching driving signals, thereby controlling drive of the corresponding LEDs.

The driving control unit 130 compares the rectified power red from the rectifying unit 110 and a predetermined reference voltage, thereby controlling drive of a corresponding switch.

Figure 2:
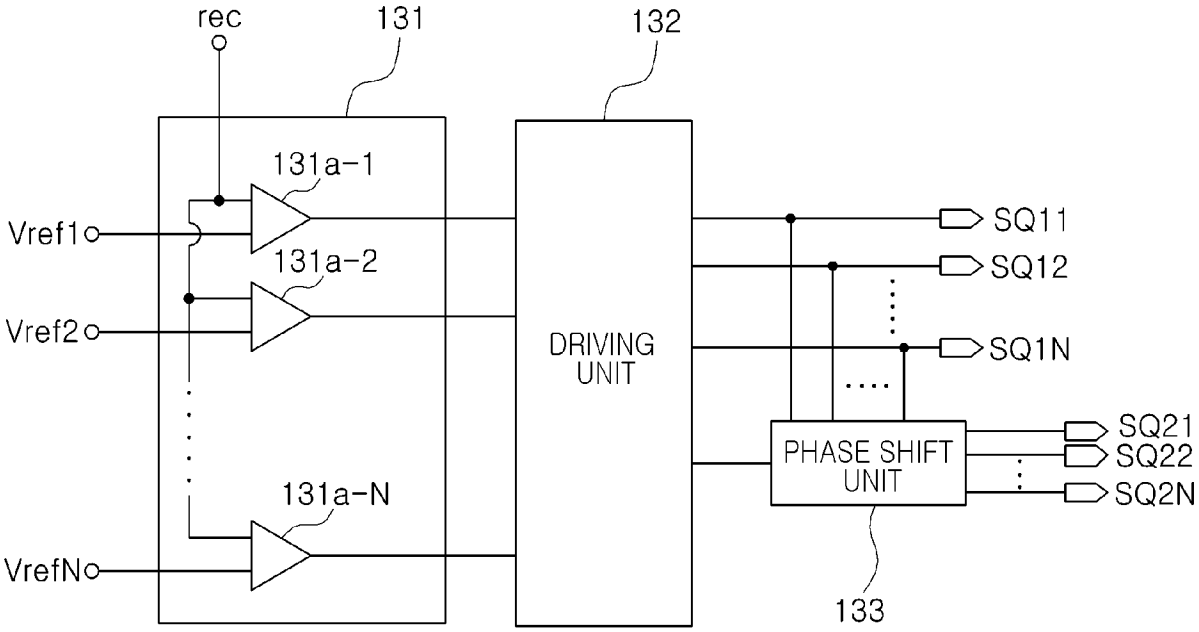
FIG. 2 is a schematic configuration diagram showing a driving control unit adapted in an apparatus for driving an LED according to an embodiment of the present invention.

FIG. 2 is a schematic configuration diagram showing a driving control unit adapted in the apparatus for driving the LED according to an embodiment of the present invention.

Referring to FIGS. 1 and 2, the driving control unit 130 may include a comparison unit 131, a driving unit 132, and a phase shift unit 133.

The comparison unit 131 may include a plurality of comparators 131-1 to 131-N, and the plurality of respective comparators 131-1 to 131-N may compare a plurality of reference voltages Vref1 to VrefN which are set in advance and the rectified power rec of the rectifying unit 110.

A comparison result of each of the plurality of comparators 131-1 to 131-N of the comparison unit 131 may be transmitted to the driving unit 132.

The driving unit 132 may provide switching driving signals SQ11 to SQ1N for driving ON/OFF switching of the corresponding switch based on the comparison result of each of the plurality of comparators 131-1 to 131-N.

The phase shift unit 133 may shift a phase of the switching driving signals SQ11 to SQ1N of the driving unit 132 to thereby output different switching driving signals SQ21 to SQ2N.

More specifically, the number of the plurality of comparators 131-1 to 131-N may correspond to the number of the plurality of switches Q11 to Q1N or Q21 to Q2N of the first switch group 121 or the second switch group 122.

Therefore, the comparison result of each of the plurality of comparators 131-1 to 131-N may be based on signals for driving the plurality of switches Q11 to Q1N or Q21 to Q2N of the first switch group 121 or the second switch group 122.

The switching driving signals SQ11 to SQ1N of the driving unit 132 may be Pulse Width Modulation (PWM) signals, and repeatedly perform ON/OFF switching of the corresponding switch while the corresponding LED is driven. The duration of driving of the corresponding LED may be determined based on the comparison result of each of the plurality of comparators 131-1 to 131-N.

The switching driving signals SQ11 to SQ1N of the driving unit 132 may PWM-drive the plurality of switches Q11 to Q1N or Q21 to Q2N of the first switch group 121 or second switch group 122. Therefore, the phase shift unit 133 may shift the phase of the switching driving signals SQ11 to SQ1N, and specifically shift the phase of the switching driving signals SQ11 to SQ1N by 180 degrees so that switches Q21 to 2N or Q11 to Q1N different from the switches Q11 to Q1N or Q21 to Q2N in charge of the switching driving signals SQ11 to SQ1N of the driving unit 132 may be PWM-driven.

For example, when the switching driving signals SQ11 to SQ1N of the driving unit 132 PWM-drive the plurality of switches Q11 to Q1N of the first switch group 121, the phase shift unit 133 may PWM-drive the plurality of switches Q21 to Q2N of the second switch group 122 by a phase difference of 180 degrees. The reverse may also be adopted in the same manner.

The current limiting unit 140 may be connected to a distal end of each of the switches Q11 to Q1N and Q21 to Q2N of the first and second switch groups 121 and 122 of the switching unit 120 so as to limit a current flowing in the corresponding LED by PWM-driving each of the switches Q11 to Q1N and Q21 to Q2N of the first and second switch groups 121 and 122.

Figure 3:
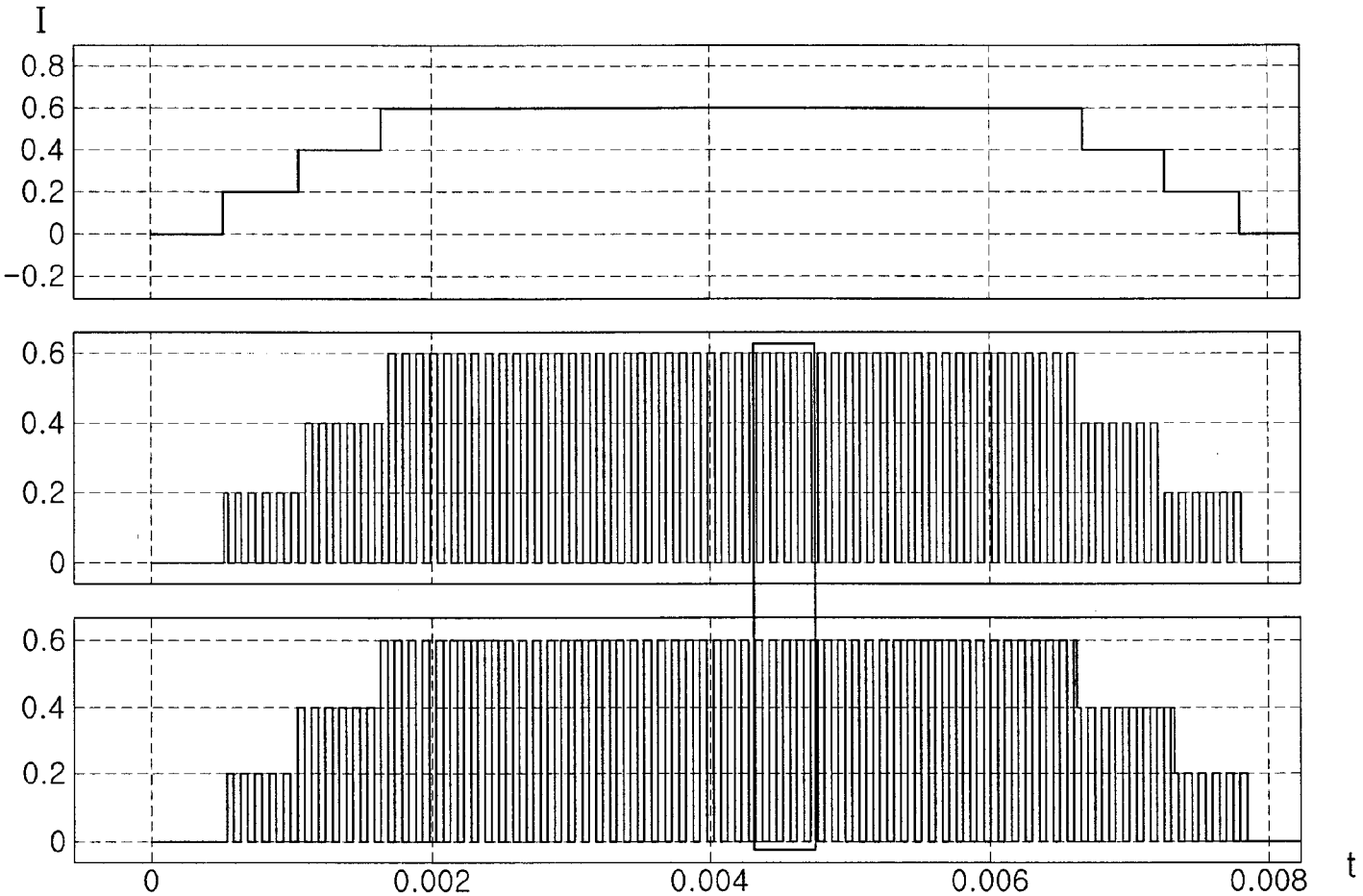
FIGS. 3 and 4 are graphs showing electrical characteristics of an apparatus for driving an LED according to an embodiment of the present invention.
Figure 4:
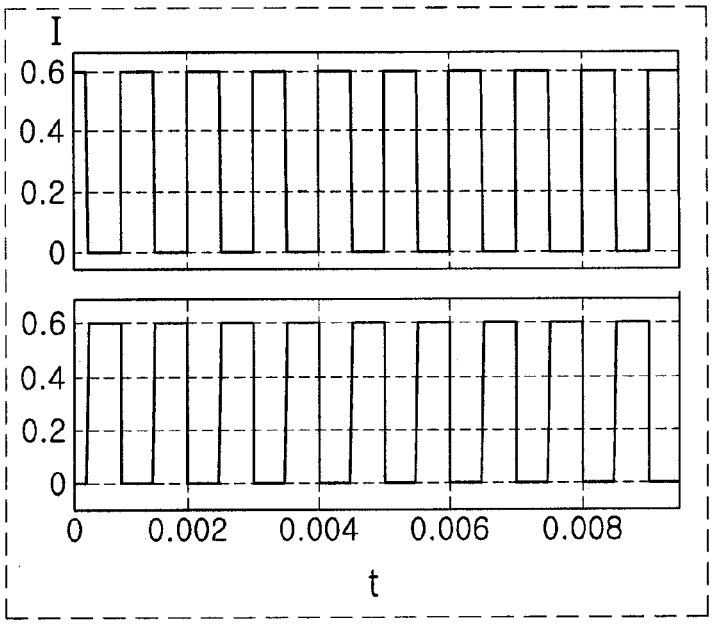

FIGS. 3 and 4 are graphs showing electrical characteristics of the apparatus for driving the LED according to an embodiment of the present invention.

Referring to FIGS. 3 and 4 together with FIGS. 1 and 2, for example, when the pair of LED units LEDG1 and LEDG2 adopted in the LED driving circuit A of the apparatus for driving the LED according to an embodiment of the present invention each include three LEDs connected to each other in series, a corresponding switch is turned on in accordance with respective voltage levels of the rectified power rec as shown in FIG. 3 so that 3-STEP power flows. In addition, as shown in FIG. 4, the first and second LED units LEDG1 and LEDG2 are PWM-driven by a phase difference of 180 degrees.

As set forth above, according to the embodiments of the present invention, a pair of LED groups may be switching-operated by a phase difference of 180 degrees therebetween so as to suppress electromagnetic interference, and therefore a separate EMI filter may not be adopted, thereby reducing manufacturing costs and circuit area, and improving a power factor and Total Harmonic Distortion (THD) characteristics.

While the present invention has been shown and described in connection with the embodiments, it will be apparent to those skilled in the art that modifications and variations can be made without departing from the spirit and scope of the invention as defined by the appended claims.

What is claimed is:

1. An apparatus for driving a light-emitting diode (LED), the apparatus comprising:

a switching unit that alternately switches a first LED unit and a second LED unit of at least one pair of LED units emitting light by receiving rectified power, in accordance with a predetermined phase difference;

a current limiting unit that limits a current flowing in the at least one pair of LED units through the switching of the switching unit; and a driving control unit that controls switching driving of the switching unit in accordance with a voltage level of the rectified power.

2. The apparatus of claim 1, wherein each of the first and second LED units includes a plurality of LEDs connected to each other in series.

3. The apparatus of claim 2, wherein the switching unit includes a switch group having a plurality of switches respectively connected between a connection point between respective LEDs of the plurality of LEDs of each of the first and second LED units and the current limiting unit.

4. The apparatus of claim 3, wherein the switching unit includes a first switch group connected to the first LED unit of the at least one pair of LED units and a second switch group connected to the second LED unit thereof.

5. The apparatus of claim 1, wherein the driving control unit controls the alternate switching of the switching unit by a phase difference of 180 degrees.

6. The apparatus of claim 5, wherein the driving control unit includes:

a comparison unit that compares the rectified power with a predetermined reference voltage;

a driving unit that provides a switching driving signal for controlling the switching driving of the first LED unit of the at least one pair of LED units in accordance with a comparison result of the comparison unit; and a phase shift unit that shifts a phase of the switching driving signal from the driving unit so as to control switching driving of the second LED unit.

7. The apparatus of claim 6, wherein the comparison unit includes a plurality of comparators corresponding to the number of LEDs contained within the first or second LED unit.

8. The apparatus of claim 7, wherein the driving unit provides a plurality of switching driving signals corresponding to the number of LEDs contained within the first LED unit.

9. The apparatus of claim 4, wherein each of the first and second switch groups includes a plurality of switches corresponding to the number of the plurality of LEDs contained within the first or second LED unit.

10. The apparatus of claim 1, further comprising:

a rectifying unit that rectifies alternating current (AC) power and provides the rectified AC power to the at least one pair of LED units.

11. An apparatus for driving an LED, the apparatus comprising:

a rectifying unit that rectifies AC power and provides the rectified AC power;

a switching unit that includes a first switch group for driving a first LED unit of at least one pair of LED units emitting light by receiving the rectified power from the rectifying unit and a second switch group for driving a second LED unit of the at least one pair of LED units, and alternately switches the first switch group and the second switch group in accordance with a predetermined phase difference;

a current limiting unit that limits a current flowing in each of the first and second LED units through the switching of the switching unit; and a driving control unit that controls switching driving of the switching unit in accordance with a voltage level of the rectified power.

12. The apparatus claim 11, wherein each of the first and second LED units includes a plurality of LEDs connected to each other in series.

13. The apparatus of claim 12, wherein each of the first and second switch groups has a plurality of switches that are respectively connected between a connection point between respective LEDs of the plurality of LEDs of each of the first or second LED unit and the current limiting unit, the plurality of switches corresponding to the number of the plurality of LEDs.

14. The apparatus of claim 11, wherein the driving control unit controls the alternate switching of the switching unit by a phase difference of 180 degrees.

15. The apparatus of claim 14, wherein the driving control unit includes:

a comparison unit that compares the rectified power with a predetermined reference voltage;

a driving unit that provides a switching driving signal for controlling ON/OFF switching of the first switch group in accordance with a comparison result of the comparison unit; and a phase shift unit that shifts a phase of the switching driving signal from the driving unit so as to control switching driving of the second LED unit.

16. The apparatus of claim 15, wherein the comparison unit includes a plurality of comparators corresponding to the number of LEDs contained within the first or second LED unit.

17. The apparatus of claim 16, wherein the driving unit provides a plurality of switching driving signals corresponding to the number of the LEDs included in the first LED unit.

* * * * *